US008901851B2

(12) United States Patent
Kuang et al.

(10) Patent No.: US 8,901,851 B2
(45) Date of Patent: Dec. 2, 2014

(54) TRIAC DIMMER COMPATIBLE LED DRIVER AND METHOD THEREOF

(75) Inventors: Naixing Kuang, Hangzhou (CN); Jiali Cai, Hangzhou (CN); Hongxia Yu, Hangzhou (CN)

(73) Assignee: Chengdu Monolithic Power Systems Co., Ltd., Chengdu (CN)

( * ) Notice: Subject to any disclaimer, the term of this patent is extended or adjusted under 35 U.S.C. 154(b) by 155 days.

(21) Appl. No.: 13/399,230

(22) Filed: Feb. 17, 2012

(65) Prior Publication Data

US 2013/0154487 A1 Jun. 20, 2013

(30) Foreign Application Priority Data

Dec. 15, 2011 (CN) ..... 2011 1 0422823

(51) Int. Cl.
*H05B 37/00* (2006.01)

(52) U.S. Cl.
USPC ..... 315/307; 315/186; 315/300

(58) Field of Classification Search
USPC ..... 315/185 R, 186, 200 R, 291, 294, 297, 315/299, 300, 307, 308, 312, 316
See application file for complete search history.

(56) References Cited

U.S. PATENT DOCUMENTS

| | | | | |
|---|---|---|---|---|
| 7,855,520 | B2 * | 12/2010 | Leng | 315/307 |
| 2011/0127925 | A1 | 6/2011 | Huang et al. | |
| 2011/0285301 | A1 | 11/2011 | Kuang et al. | |
| 2012/0104970 | A1 * | 5/2012 | Okubo et al. | 315/291 |
| 2013/0009556 | A1 * | 1/2013 | Szczeszynski et al. | 315/185 R |
| 2013/0082624 | A1 * | 4/2013 | Brassfield et al. | 315/297 |

* cited by examiner

*Primary Examiner* — Tung X Le
(74) *Attorney, Agent, or Firm* — Perkins Coie, LLP

(57) ABSTRACT

The present invention provides a controller used in a TRIAC dimmer compatible LED driver and method thereof. The controller comprises a dimming signal generator, a dimming signal processor and a switch control circuit. The dimming signal generator receives an AC chopped voltage from a TRIAC dimmer and generates a dimming signal with regulated duty cycle in accordance with the AC chopped voltage. The dimming signal processor is coupled to the dimming signal generator and generates a processed dimming signal in accordance with the dimming signal. The duty cycle of the processed dimming signal is a sum of a predetermined duty cycle and the duty cycle of the dimming signal. Based on the processed dimming signal and a feedback signal indicative of the current flowing through LED, the switch control circuit generates a control signal to control at least one switch in a switching converter.

19 Claims, 11 Drawing Sheets

TRIAC DIMMER COMPATIBLE LED DRIVER AND METHOD THEREOF

CROSS-REFERENCE TO RELATED APPLICATION(S)

This application claims the benefit of CN application 201110422823.X, filed on Dec. 15, 2011, and incorporated herein by reference.

TECHNICAL FIELD

Embodiments of the present invention generally relate to electronic circuits, and more particularly, relate to TRIAC dimmer compatible LED drivers and methods thereof.

BACKGROUND

Currently, it is a major trend to replace existing bulbs with light emitting diodes (LED). However, how to make the LED driver compatible with traditional TRIAC dimmers becomes a challenge. The traditional TRIAC dimmer is designed for pure resistive loads, such as incandescent or halogen lamp. The TRIAC dimmer adjusts the ON time of a TRIAC (triode AC semiconductor switch) to control the power supplied to the load, so as to realize dimming. Since the LED is not a pure resistive load, its dimming performance with TRIAC dimmer is often unsatisfactory.

FIG. 1 illustrates a typical TRIAC dimmer. The TRIAC dimmer comprises a TRIAC TR1, a potentiometer POT1, a capacitor C1, a DIAC (bidirectional trigger diode) D1, and resistors R1, R2. The TRIAC TR1, potentiometer POT1, capacitor C1, and the resistors R1, R2 form a phase shift trigger network. When the voltage across the capacitor C1 is increased to reach the breakover voltage of the DIAC D1, such as 30V, the DIAC D1 is broken down. The TRIAC TR1 is turned on, and the capacitor C1 is discharged through the resistors R1, R2 and the potentiometer POT1. Once the TRIAC TR1 is turned on, it will maintain on until the AC input voltage $V_{ac}$ crosses zero or the current flowing through the TRIAC TR1 becomes smaller than a holding current.

The charge time of the capacitor C1 can be changed through adjusting the potentiometer POT1, so as to change the conduction phase of the voltage supplied to the load (the AC chopped voltage $V_{tr}$). The conduction phase is corresponding to the ON time of the TRIAC TR1 in one cycle. When the potentiometer POT1 is adjusted to its maximum resistance, it is deemed as open. The resistor R1 and R2 are serially connected and the conduction phase of the AC chopped voltage $V_{tr}$ reaches its minimum value. When the potentiometer POT1 is adjusted to be zero resistance, the resistor R1 is shorted. The conduction phase of the AC chopped voltage $V_{tr}$ reaches its maximum value.

FIG. 2 illustrates a prior TRIAC dimmer compatible LED driver. The TRIAC dimmer receives an AC input voltage $V_{ac}$ from an AC power supply, and generates an AC chopped voltage $V_{tr}$ with regulated conduction phase. The rectifier rectifies the AC chopped voltage $V_{tr}$ to generate a DC chopped voltage $V_{bus}$. A flyback converter comprising a switch S1, a transformer T1 and a diode D2 receives the DC chopped voltage $V_{bus}$, and converts it into a driving signal to drive LEDs. A comparator COM1 compares a voltage sensing signal $V_{sense1}$ indicative of the DC chopped voltage $V_{bus}$ with a threshold voltage $V_{th1}$ to generate a dimming signal DIM. An error amplifier EA compares the dimming signal DIM with a feedback signal FB indicative of the current flowing through LED to generate a compensation signal COMP. A logic circuit generates a control signal CTRL based on the compensation signal COMP, so as to control the ON and OFF switching of the switch S1.

FIG. 3 is a waveform of the LED driver shown in FIG. 2. When the voltage sensing signal $V_{sense1}$ is larger than the threshold voltage $V_{th1}$, the dimming signal DIM is equal to $V_H$, wherein $V_H$ is positive ($V_H$>0). When the voltage sensing signal $V_{sense1}$ is smaller than the threshold voltage $V_{th1}$, the dimming signal DIM is zero. The feedback signal FB is regulated to the average value of the dimming signal DIM, $D*V_H$, by the error amplifier EA and the logic circuit, wherein D is the duty cycle of the dimming signal DIM.

As shown in FIG. 1, the charge time of the capacitor C1 and the conduction phase of the AC chopped voltage $V_{tr}$ will vary with the AC input voltage $V_{ac}$. So for certain TRIAC dimmer, the maximum and minimum brightness of the LED are different under different AC input voltage $V_{ac}$. Besides this, for different TRIAC dimmers, even under the same AC input voltage $V_{ac}$, the maximum and minimum brightness of the LED are also different because of the manufacture deviation.

Furthermore, the conduction phase of the AC chopped voltage $V_{tr}$ can not be adjusted to zero because of the resistor R1. So the brightness of the LED can not reach zero. The dimming range of the LED is narrow, especially under high AC input voltage $V_{ac}$.

Moreover, the line regulation of the prior LED driver is poor. When the TRIAC dimmer is eliminated, the AC chopped voltage $V_{tr}$ is equal to the AC input voltage $V_{ac}$. Since the time when the DC chopped voltage $V_{bus}$ is increased to reach the threshold voltage $V_{th}$ varies with the AC input voltage $V_{ac}$, the duty cycle D of the dimming signal DIM and the brightness of the LED are different under different AC input voltage $V_{ac}$.

SUMMARY

The present invention is directed to a TRIAC dimmer compatible LED driver and method thereof. In one embodiment of the present disclosure, the LED driver comprises a TRIAC dimmer, a rectifier, a switching converter having at least one switch, a feedback circuit and a controller. The TRIAC dimmer receives an AC input voltage and generates an AC chopped voltage having regulated conduction phase based on the AC input voltage. The rectifier rectifies the AC chopped voltage to generate a DC chopped voltage. The switching converter converts the DC chopped voltage into a driving signal to drive the LED. The feedback circuit is coupled to the switching converter to generate a feedback signal indicative of the current flowing through the LED.

The controller comprises a dimming signal generator, a dimming signal processor and a switch control circuit. The dimming signal generator is coupled to the TRIAC dimmer and generates a dimming signal with regulated duty cycle in accordance with the AC chopped voltage. The dimming signal processor is coupled to the dimming signal generator and generates a processed dimming signal in accordance with the dimming signal. The duty cycle of the processed dimming signal is a sum of a predetermined duty cycle and the duty cycle of the dimming signal. The switch control circuit is coupled to the dimming signal processor and the feedback circuit. Based on the processed dimming signal and the feedback signal, the switch control circuit generates a control signal to control the at least one switch in the switching converter.

In one embodiment, the controller further comprises a reference signal generator coupled between the dimming signal processor and the switch control circuit. The reference signal generator generates a reference signal in accordance with the processed dimming signal. The average value of the reference signal is the difference between the product of a first constant and the duty cycle of the processed dimming signal, and a second constant, wherein the first constant is larger than the second constant. The switch control circuit generates the control signal based on the reference signal and the feedback signal.

In one embodiment, the dimming signal processor is not necessary. The reference signal generator may be directly coupled to the dimming signal generator, and generate the reference signal in accordance with the dimming signal. The average value of the reference signal is the difference between the product of a first constant and the duty cycle of the dimming signal, and a second constant.

BRIEF DESCRIPTION OF THE DRAWINGS

The present invention can be further understood with reference to the following detailed description and the appended drawings, wherein like elements are provided with like reference numerals.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
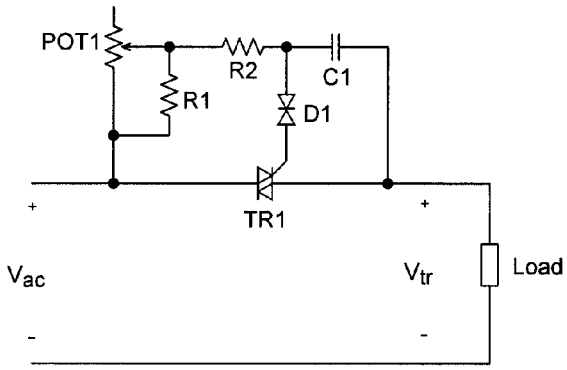
FIG. 1 (Prior Art)
FIG. 1 illustrates a typical TRIAC dimmer.
Figure 2:
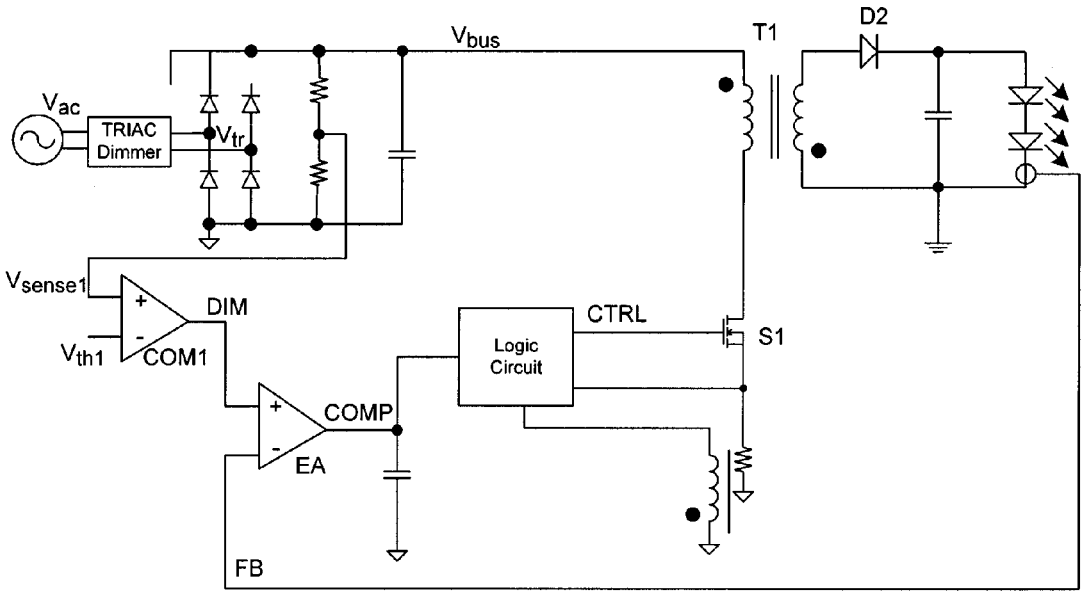
FIG. 2 (Prior Art)
FIG. 2 illustrates a prior TRIAC dimmer compatible LED driver.
Figure 3:
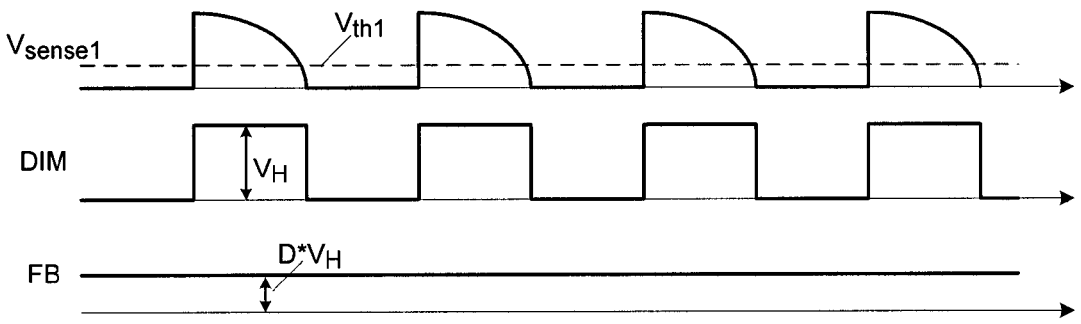
FIG. 3 (Prior Art)
FIG. 3 is a waveform of the LED driver shown in FIG. 2.
Figure 4:
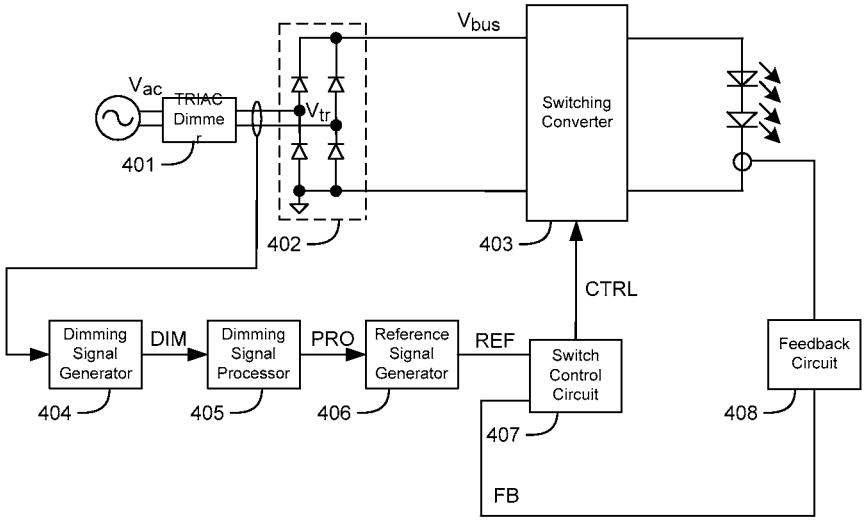
FIG. 4 is a block diagram of a LED driver in accordance with an embodiment of the present disclosure.

FIG. 4 is a block diagram of a LED driver in accordance with an embodiment of the present disclosure. The LED driver comprises a TRIAC dimmer 401, a rectifier 402, a switching converter 403, a feedback circuit 408 and a controller. The controller comprises a dimming signal generator 404, a dimming signal processor 405 and a switch control circuit 407. The TRIAC dimmer 401 receives an AC input voltage $V_{ac}$ from an AC power supply, and generates an AC chopped voltage $V_{tr}$ having a regulated conduction phase based on the AC input voltage $V_{ac}$. The rectifier 402 is coupled to the TRIAC dimmer 401, and rectifies the AC chopped voltage $V_{tr}$ to generate a DC chopped voltage $V_{bus}$. The switching converter 403 comprises at least one switch. The switching converter 403 converts the DC chopped voltage $V_{bus}$ into a driving signal to drive LED through the ON and OFF switching of the at least switch. The switching converter 403 may be configured in any DC/DC topology, such as buck converter, boost converter, flyback converter and so on. The at least one switch in the switching converter 403 may be any controllable semiconductor device, such as MOSFET (metal oxide semiconductor field effect transistor), IGBT (isolated gate bipolar transistor) and so on.

The feedback circuit 408 is coupled to the switching converter 403 to generate a feedback signal FB indicative of the current flowing through the LED. In one embodiment, the feedback circuit 408 comprises a sensing resistor serially coupled to the LED.

The dimming signal generator 404 is coupled to the TRIAC dimmer 401, and generates a dimming signal DIM in accordance with the AC chopped voltage $V_{tr}$. The duty cycle of the dimming signal DIM is regulated by the conduction phase of the AC chopped voltage $V_{tr}$. In one embodiment, the dimming signal generator 404 comprises a comparing circuit. The comparing circuit receives a voltage sensing signal indicative of the DC chopping voltage $V_{tr}$, and compares it with a first threshold voltage to generate the dimming signal DIM. In another embodiment, the dimming signal generator 404 rectifies the AC chopped voltage $V_{tr}$, and compares the rectified voltage with a threshold voltage to generate the dimming signal DIM. In still another embodiment, the dimming signal generator 404 compares the AC chopped voltage $V_{tr}$ with two threshold voltage to generate the dimming signal DIM. The sign of the two threshold voltage are opposite (one positive and one negative) while their absolute value are the same.

The dimming signal processor 405 is coupled to the dimming signal generator 404, and generates a processed dimming signal PRO in accordance with the dimming signal DIM. The duty cycle of the processed dimming signal PRO is a sum of a predetermined duty cycle D1 and the duty cycle D of the dimming signal DIM. The switch control circuit 407 is coupled to the dimming signal processor 405, and generates a control signal CTRL based on the processed dimming signal PRO and the feedback signal FB to control the at least one switch in the switching converter 403.

Generally, the predetermined duty cycle D1 is chosen to be a little bit larger than $1-D_{max}$, wherein $D_{max}$ is the rated maximum duty cycle of the dimming signal DIM. In one embodiment, $D_{max}$ is 80% and D1 is 25%. Since the duty cycle of the processed dimming signal PRO is a sum of the predetermined duty cycle D1 and the duty cycle D of the dimming signal DIM, whenever D is larger than or equal to 1−D1, the duty cycle of the processed dimming signal PRO is 1. So the maximum brightness of the LED under different conditions is uniform.

In one embodiment, the controller further comprises a reference signal generator 406. The reference signal generator 406 is coupled between the dimming signal processor 405 and the switch control circuit 407, and generates a reference signal REF in accordance with the processed dimming signal PRO. The average value of the reference signal REF is the difference between the product of a first constant K1 and the duty cycle of the processed dimming signal PRO, and a second constant K2, wherein K1 and K2 are both positive, and K1 is larger than K2. That means the average value of the reference signal REF is K1*(D+D1)−K2. The switch control circuit 407 generates the control signal CTRL based on the reference signal REF and the feedback signal FB. Generally, the constant K1 and K2 are chosen to let K2/K1 be a little bit larger than $D1+D_{min}$, wherein $D_{min}$ is the rated minimum duty cycle of the dimming signal DIM.

In one embodiment, the reference signal REF is an AC pulse signal of which the duty cycle is equal to that of the dimming signal DIM. The high level of the reference signal REF is positive, and the low level of the reference signal REF is negative. In another embodiment, the reference signal REF is a DC pulse signal of which the duty cycle is K1*(D+D1)−K2. In one embodiment, the duty cycle D of the dimming signal DIM is converted into a digital signal. The dimming signal processor 405 and the reference signal generator 406 are both realized by a digital signal processor through executing some programs.

In one embodiment, the switch control circuit 407 converts the reference signal REF into a DC signal through a filter, and compares the DC signal with a triangular wave signal to generate a signal for PWM dimming. In another embodiment, the switch control circuit 407 compares the reference signal REF with the feedback signal FB to generate a compensation signal, and generates the control signal CTRL based on the compensation signal. The switch control circuit 407 may use any known control method, such as quasi-resonant control, fixed frequency peak current control, constant on time control, off time control and so on. The switch control circuit 407 may also comprise the function of power factor correction.

Figure 5:
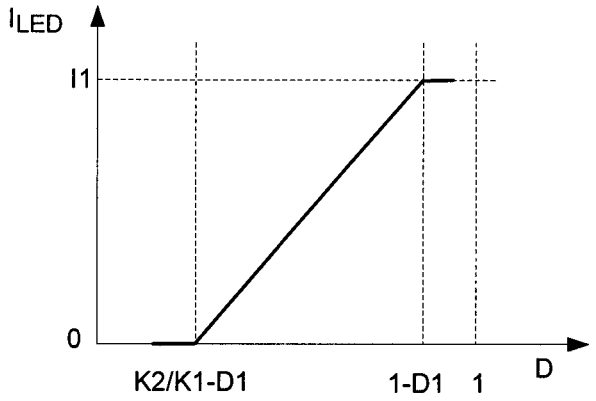
FIG. 5 is a dimming curve of the LED driver shown in FIG. 4.

FIG. 5 is a dimming curve of the LED driver shown in FIG. 4. When the duty cycle D of the dimming signal DIM is larger than or equal to 1−D1, the duty cycle of the processed dimming signal PRO is 1. The current $I_{LED}$ flowing through the LED is I1, and the LED reaches its maximum brightness. When the duty cycle D of the dimming signal DIM is smaller than or equal to K2/K1−D1, the average value of the reference signal REF is zero. The current $I_{LED}$ flowing through the LED is 0, and the LED is off.

Although the maximum conduction phase of the AC chopped voltage $V_{tr}$ is different under different AC input voltage $V_{ac}$ or different TRIAC dimmers, the duty cycle of their corresponding processed dimming signal PRO are all equal to 1. So the maximum brightness of the LED is uniform under different conditions. For the same reason, although the minimum conduction phase of the AC chopped voltage $V_{tr}$ are different under different conditions, the duty cycle of their corresponding processed dimming signal PRO are all equal to 0. So the minimum brightness of the LED is uniform under different conditions. Since the minimum brightness of the LED is zero, the dimming range of the LED is extended.

Furthermore, the line regulation of the LED driver shown in FIG. 4 is good. When the TRIAC dimmer 401 is eliminated, even the duty cycle D of the dimming signal DIM are different under different AC input voltage $V_{ac}$, the duty cycle of their corresponding processed dimming signal PRO are all equal to 1. So the brightness of the LED is uniform.

Figure 6:
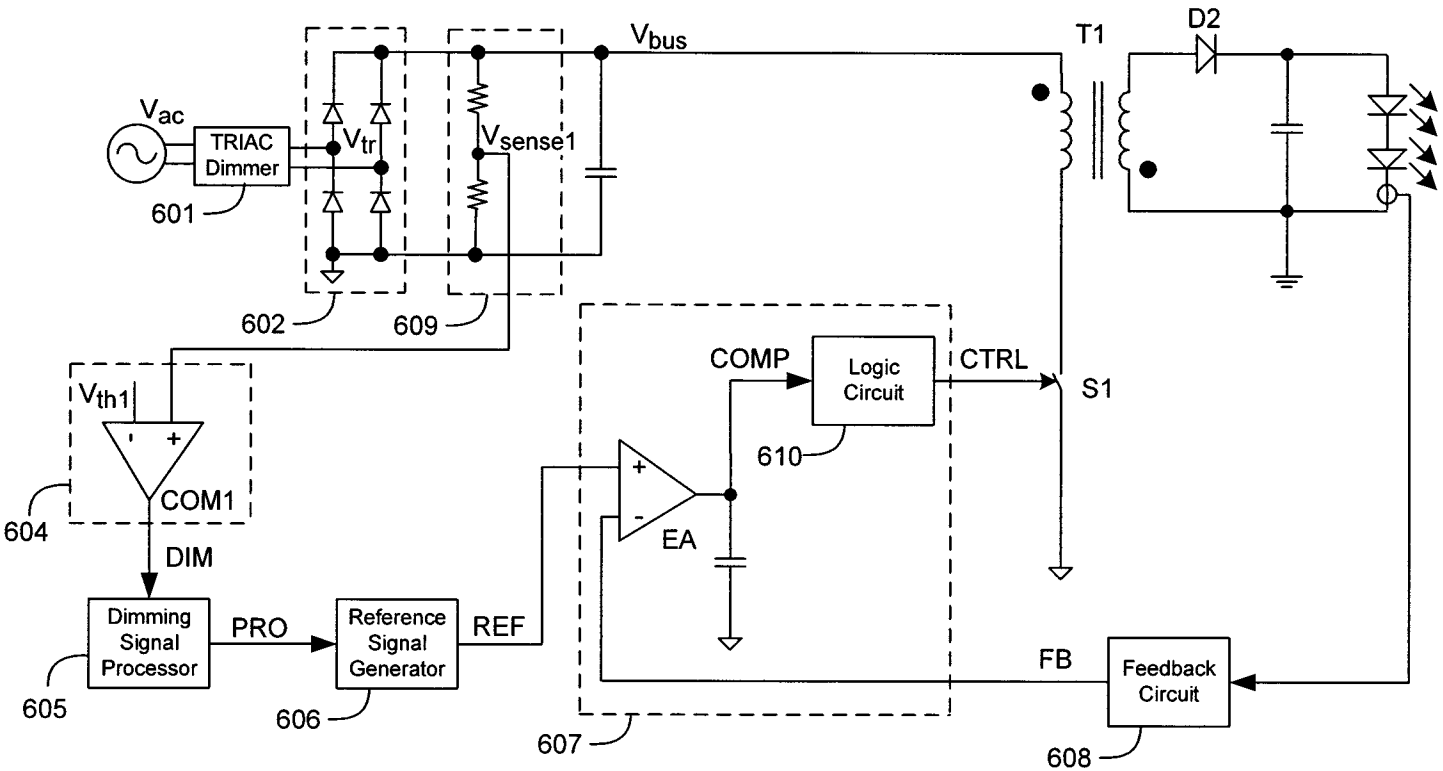
FIG. 6 illustrates a LED driver in accordance with one embodiment of the present disclosure.

FIG. 6 illustrates a LED driver in accordance with one embodiment of the present disclosure. The LED driver comprises a TRIAC dimmer 601, a rectifier 602, a switching converter, a dimming signal generator 604, a dimming signal processor 605, a reference signal generator 606, a switch control circuit 607, a feedback circuit 608 and a voltage sensing circuit 609. The switching converter is a flyback converter comprising a transformer T1, a switch S1 and a diode D2. The diode D2 may be replaced by a synchronous switch. The voltage sensing circuit 609 is coupled to the output terminal of the rectifier 602 to sense the DC chopped voltage $V_{bus}$ and generate a voltage sensing signal $V_{sense1}$. In one embodiment, the voltage sensing circuit 609 comprises a resistor divider.

The dimming signal generator 604 comprises a comparator COM1. The non-inverting input terminal of the comparator COM1 is coupled to the voltage sensing circuit 609 to receive the voltage sensing signal $V_{sense1}$, the inverting input terminal of the comparator COM1 receives a threshold voltage $V_{th1}$. The comparator COM1 provides the dimming signal DIM at its output terminal. The switch control circuit 607 comprises an error amplifier EA and a logic circuit 610. The error amplifier EA is coupled to the reference signal generator 606 and the feedback circuit 608, and generates a compensation signal COMP based on the reference signal REF and the feedback signal FB. The error amplifier EA may be an operational amplifier or a transconductance amplifier. The logic circuit 610 is coupled to the output terminal of the error amplifier EA, and generates the control signal CTRL based on the compensation signal COMP. In one embodiment, there is a filter coupled between the reference signal generator 606 and the error amplifier EA.

Figure 7:
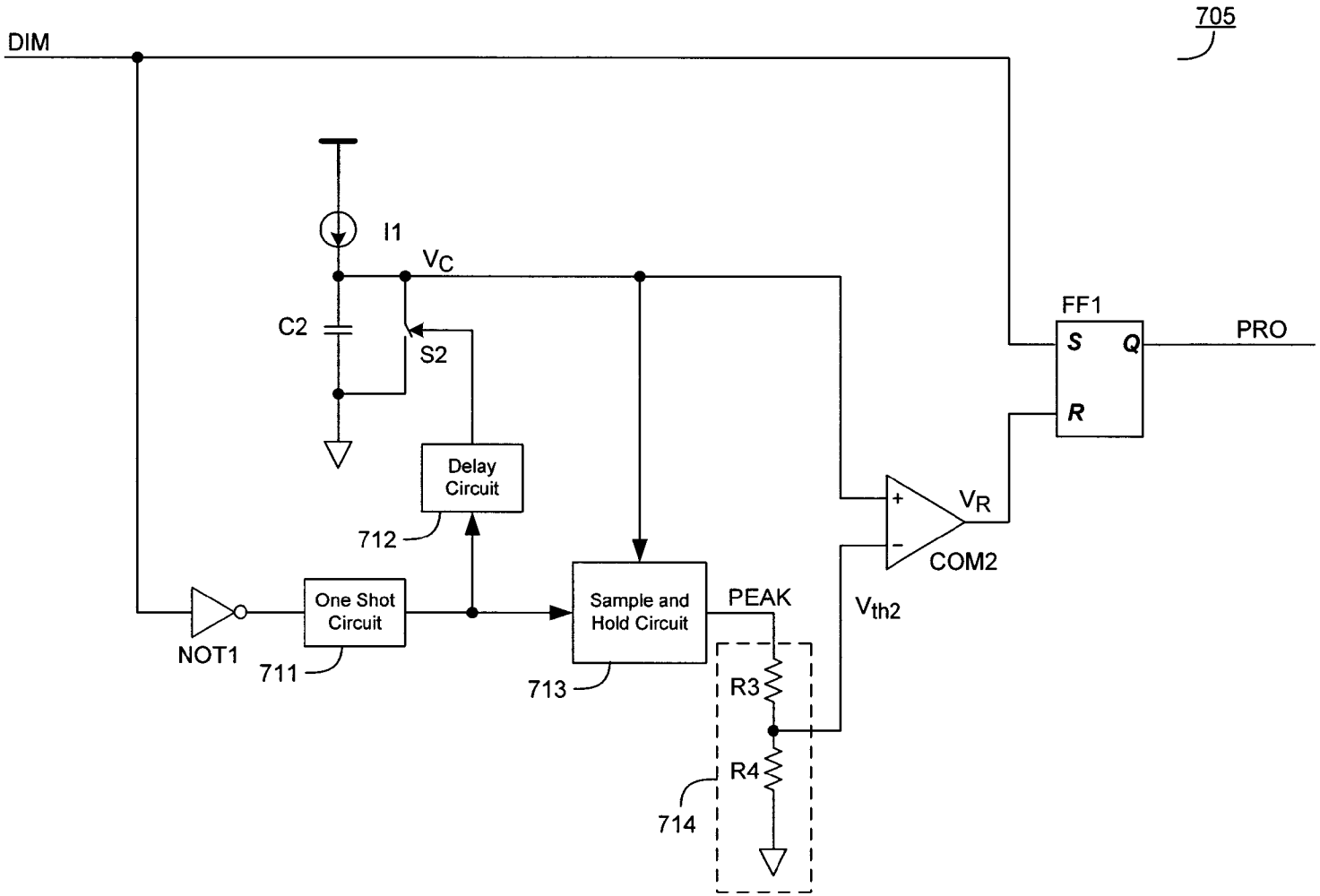
FIG. 7 illustrates a dimming signal processor in accordance with one embodiment of the present disclosure.

FIG. 7 illustrates a dimming signal processor 705 in accordance with one embodiment of the present disclosure. The dimming signal processor 705 comprises a NOT gate NOT1, a one shot circuit 711, a current source I1, a capacitor C2, a switch S2, a comparator COM2 and a flip flop FF1. The input terminal of the NOT gate NOT1 is coupled to the dimming signal generator to receive the dimming signal DIM. The input terminal of the one shot circuit 711 is coupled to the output terminal of the NOT gate NOT1. The capacitor C2 has a first terminal and a second terminal, wherein the first terminal is coupled to the current source I1 and the second terminal is grounded. The switch S2 is coupled to the capacitor C2 in parallel. The gate of the switch S2 is coupled to the output terminal of the one shot circuit 711. The non-inverting input terminal of the comparator COM2 is coupled to the first terminal of the capacitor C2, the inverting input terminal of the comparator COM2 receives a threshold voltage $V_{th2}$. The flip flop FF1 has a set terminal, a reset terminal and an output terminal. The set terminal is coupled to the dimming signal generator to receive the dimming signal DIM, the reset terminal is coupled to the output terminal of the comparator COM2. The flip flop FF1 provides the processed dimming signal PRO at its output terminal.

In one embodiment, the dimming signal processor 705 further comprises a delay circuit 712, a sample and hold circuit 713 and a voltage divider 714. The sample and hold circuit 713 has a first input terminal, a second input terminal and an output terminal. The first input terminal is coupled to the output terminal of the one shot circuit 711, the second input terminal is coupled to the first terminal of the capacitor C2. Based on the output signal of the one shot circuit 711 and the voltage $V_c$ across the capacitor C2, the sample and hold circuit 713 provides a sample and hold signal PEAK indicative of the peak voltage across the capacitor C2 at its output terminal. The delay circuit 712 is coupled between the output terminal of the one shot circuit 711 and the gate of the switch S2, so as to ensure the peak voltage across the capacitor C2 can be sensed well and truly. The input terminal of the voltage divider 714 is coupled to the sample and hold circuit 713 to receive the sample and hold signal PEAK. The output terminal of the voltage divider 714 is coupled to the inverting input terminal of the comparator COM2 to provide the threshold voltage $V_{th2}$.

In one embodiment, the voltage divider 714 is a resistor divider comprising two serially connected resistors, R3 and R4. The predetermined duty cycle D1 can be adjusted through changing the ratio of the voltage divider 714. In one embodiment, the resistance of the resistor R3 is three times of that of the resistor R4, so the threshold voltage $V_{th2}$ is equal to PEAK/4 and the predetermined duty cycle D1 is 25%.

Figure 8:
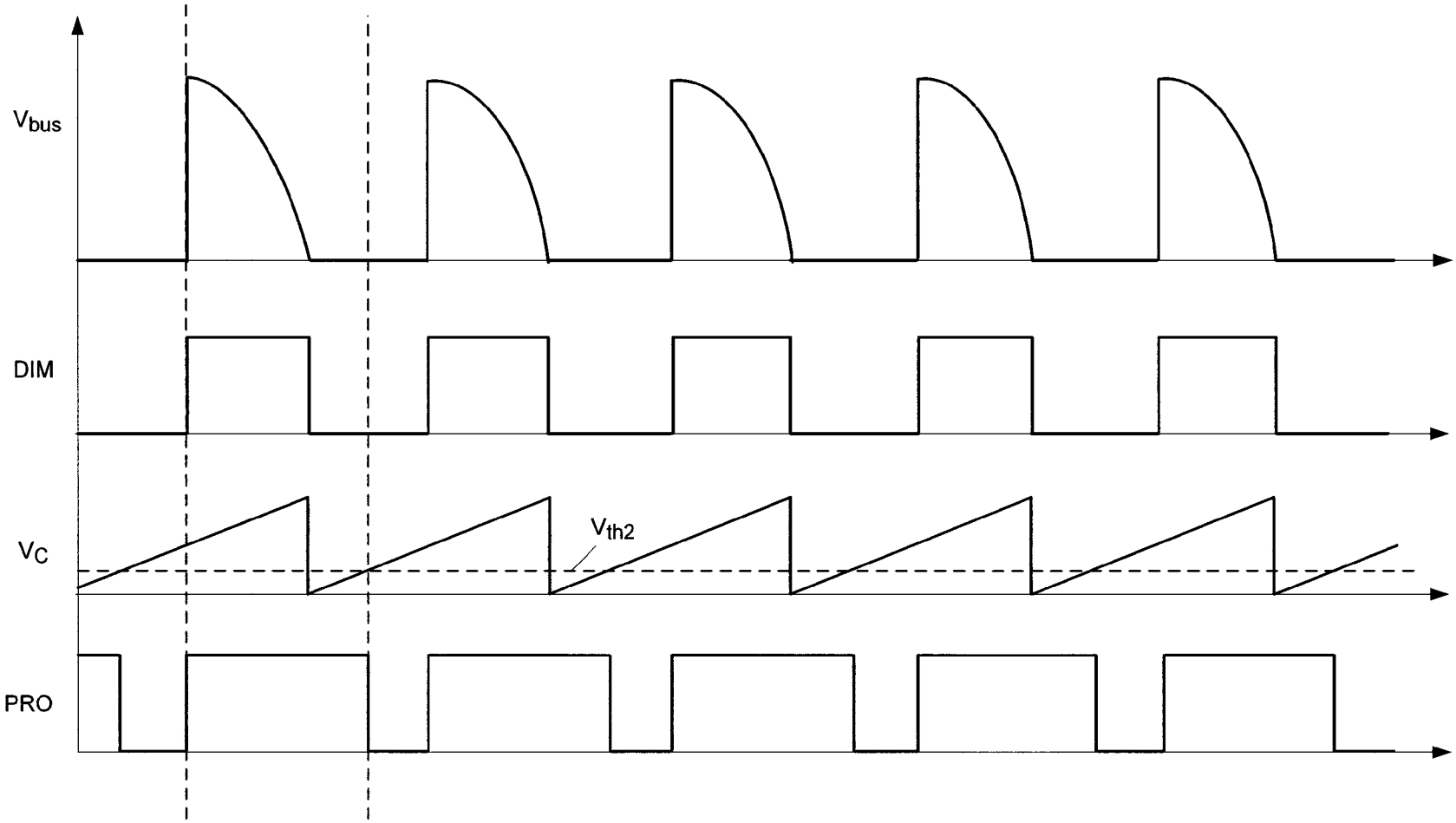
FIG. 8 is a waveform of the dimming signal processor shown in FIG. 7.

FIG. 8 is a waveform of the dimming signal processor 705 shown in FIG. 7. When the TRIAC in the TRIAC dimmer is turned on, the dimming signal DIM is changed from low level into high level and the flip flop FF1 is set. The processed dimming signal PRO is also changed from low level into high level. When the AC input voltage $V_{ac}$ crosses zero or the current flowing through the TRIAC becomes smaller than the holding current, the TRIAC is turned off. The dimming signal DIM is changed from high level into low level. The one shot circuit 711 is trigged to generate a pulse signal. The sample and hold circuit 713 is triggered by the pulse signal. The voltage $V_c$ across the capacitor C2 is sampled and held. The voltage divider 714 generates the threshold voltage $V_{th2}$ in accordance with the sample and hold signal PEAK. The pulse signal generated by the one shot circuit 711 is also transmitted to the gate of the switch S2 through the delay circuit 712. The switch S2 is turned on for a predetermined time period to discharge the capacitor C2. After then, the switch S2 is turned off. The capacitor C2 is charged by the current source I1, and the voltage $V_c$ across the capacitor C2 is increased. When the voltage $V_c$ is increased to be larger than or equal to the threshold voltage $V_{th2}$, the flip flop FF1 is reset and the processed dimming signal PRO is changed from high level into low level.

Figure 9:
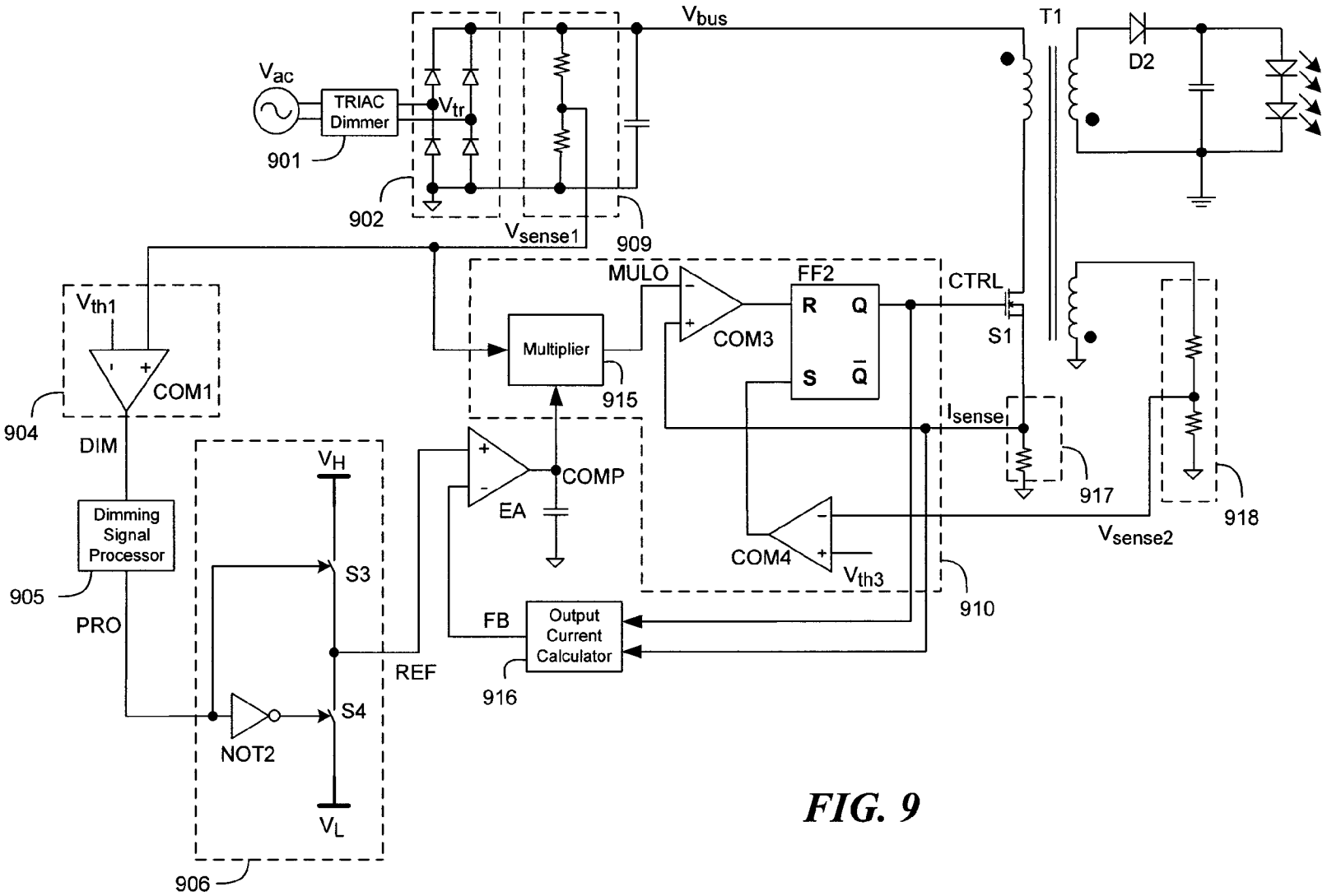
FIG. 9 illustrates a LED driver in accordance with one embodiment of the present disclosure.

FIG. 9 illustrates a LED driver in accordance with one embodiment of the present disclosure. The LED driver comprises a TRIAC dimmer 901, a rectifier 902, a switching converter, a dimming signal generator 904, a dimming signal processor 905, a reference signal generator 906, a switch control circuit 907 (not shown), a feedback circuit, a voltage sensing circuit 909, a current sensing circuit 917 and a switch voltage sensing circuit 918. The switching converter is a flyback converter comprising a transformer T1, a switch S1 and a diode D2. The transformer T1 comprises a primary winding, a secondary winding and an auxiliary winding. The switch S1 is a NMOS (n-channel MOSFET).

The reference signal generator 906 comprises switches S3, S4 and a NOT gate NOT2. The switch S3 has a first terminal, a second terminal and a gate. The first terminal of the switch S3 receives a positive voltage $V_H$ ($V_H$>0), the gate is coupled to the dimming signal processor 905 to receive the processed dimming signal PRO. The input terminal of the NOT gate NOT2 is coupled to the dimming signal processor 905 to receive the processed dimming signal PRO. The switch S4 has a first terminal, a second terminal and a gate. The first terminal of the switch S4 and the second terminal of the switch S3 are coupled together to provide the reference signal REF. The second terminal of the switch S4 receives a negative voltage $V_L$ ($V_L$>0), the gate of the switch S4 is coupled to the output terminal of the NOT gate NOT2.

The reference signal REF is an AC pulse signal. Its duty cycle is equal to that of the processed dimming signal PRO, D+D1. The high level of the reference signal REF is equal to the positive voltage $V_H$, and the low level of the reference signal REF is equal to the negative voltage $V_L$. The average value of the reference signal REF is $V_H$*(D+D1)+$V_L$*(1−D−D1). That means K1=$V_H$−$V_L$, and K2=−$V_L$.

The current sensing circuit 917 senses the current flowing through the switch S1 and generates a current sensing signal $I_{sense}$. In one embodiment, the current sensing circuit 917 comprises a sensing resistor coupled between the source of the switch S1 and the ground.

The switch voltage sensing circuit 918 senses the voltage across the switch S1 and generates a switch voltage sensing signal $V_{sense2}$. In one embodiment, the switch voltage sensing circuit 918 comprises a resistor divider coupled to the auxiliary winding of the transformer T1.

The switch control circuit 907 comprises an error amplifier EA and a logic circuit 910. The error amplifier EA is an operational amplifier. The non-inverting input terminal of the error amplifier EA is coupled to the reference signal generator 906 to receive the reference signal REF, the inverting input terminal is coupled to the feedback circuit to receive the feedback signal FB. Based on the reference signal REF and the feedback signal FB, the error amplifier EA provides a compensation signal COMP at its output terminal.

The logic circuit 910 comprises a multiplier 915, a flip flop FF2 and comparators COM3, COM4. The multiplier 915 is coupled to the error amplifier EA and the voltage sensing circuit 909, multiplies the compensation signal COMP and the voltage sensing signal $V_{sense1}$ to generate a product signal MULO. The comparator COM3 is coupled to the multiplier 915 and the current sensing circuit 917, compares the product signal MULO with the current sensing signal $I_{sense}$. The comparator COM4 is coupled to the switch voltage sensing circuit 918, and compares the switch voltage sensing signal $V_{sense2}$ with a threshold voltage $V_{th3}$. The flip flop FF2 has a set terminal, a reset terminal and an output terminal. The reset terminal of the flip flop FF2 is coupled to the output terminal of the comparator COM3, the set terminal is coupled to the output terminal of the comparator COM4, the output terminal is coupled to the gate of the switch S1.

When the switch S1 is ON, energy is stored in the transformer T1. The current flowing through the switch S1 and the current sensing signal $I_{sense}$ are increased. When the current sensing signal $I_{sense}$ is increased to be larger than or equal to the product signal MULO, the comparator COM3 generates a high level to reset the flip flop FF2. The switch S1 is turned off.

When the switch S1 is OFF, the energy stored in the transformer T1 is transferred to the load, LED. After all the stored energy being transferred to the load, the magnetization inductance of the transformer T1 and the parasitic capacitance of the switch S1 become resonant. When the voltage across the switch S1 reaches its valley to let the switch voltage sensing signal $V_{sense2}$ be smaller than or equal to the threshold voltage $V_{th3}$, the comparator COM4 generates a high level to set the flip flop FF2. The switch S1 is turned on.

In one embodiment, the feedback circuit comprises an output current calculator 916. The output current calculator 916 is coupled to the current sensing circuit 917 and the logic circuit 910, receives the current sensing signal $I_{sense}$ and the control signal CTRL and generates an output current estimate signal indicative of the current flowing through the LED. The output current estimate signal is provided to the error amplifier EA as the feedback signal FB.

Figure 10A:
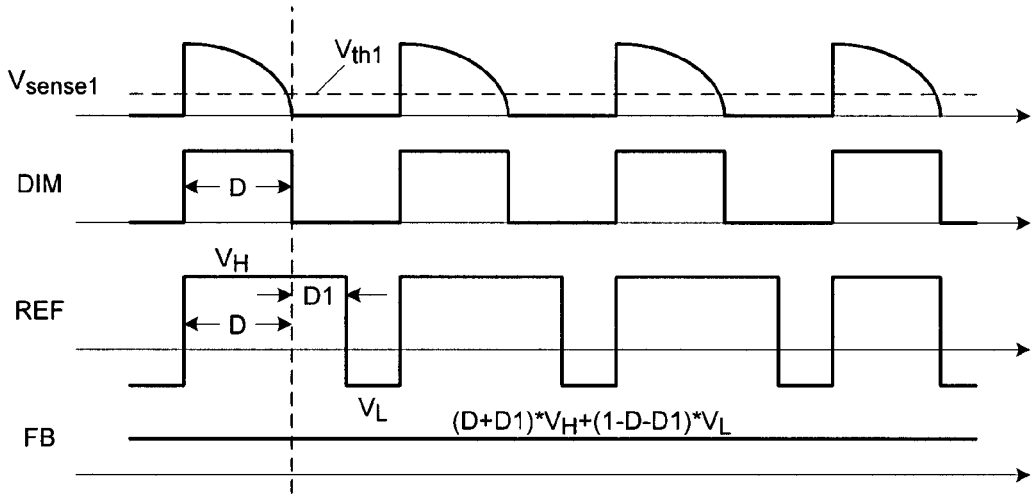
FIGS. 10A and 10B are the waveforms of the LED driver shown in FIG. 9.
Figure 10B:
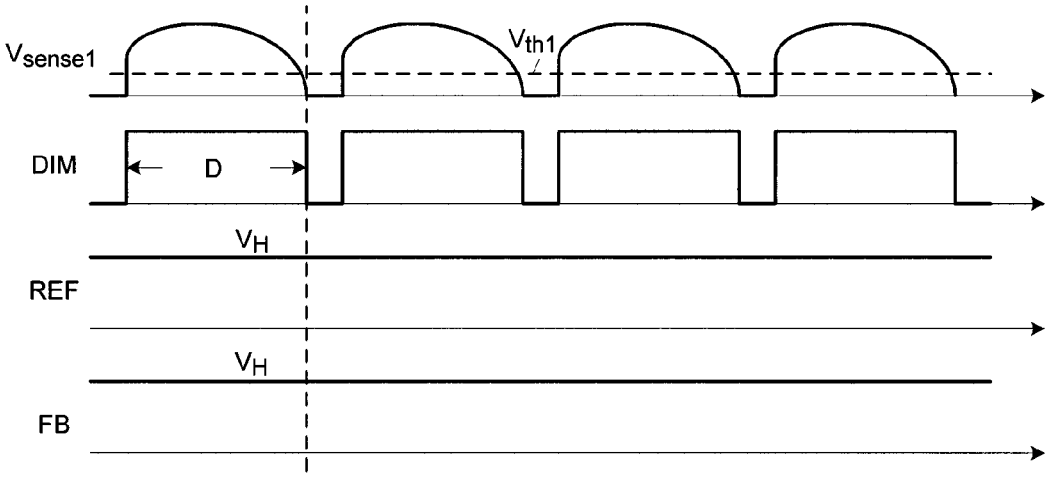

FIGS. 10A and 10B are the waveforms of the LED driver shown in FIG. 9. In FIG. 10A, the conduction phase of the DC chopped voltage $V_{bus}$ is small. The duty cycle D of the dimming signal DIM is smaller than 1−D1, and the duty cycle of the reference signal REF is D+D1. The feedback signal FB is regulated to the average value of the reference signal REF, $V_H$*(D+D1)+$V_L$*(1−D−D1).

In FIG. 10B, the conduction phase of the DC chopped voltage $V_{bus}$ is large. The duty cycle D of the dimming signal DIM is larger than 1−D1, and the duty cycle of the reference signal REF is 1. The feedback signal FB is regulated to the average value of the reference signal REF, $V_H$. So as long as the duty cycle D of the dimming signal DIM is larger than or equal to 1−D1, the brightness of the LED is the same.

Furthermore, when the duty cycle D of the dimming signal DIM is smaller than or equal to $-V_L/(V_H-V_L)-D1$, the average value of the reference signal REF is zero and the LED is off.

Figure 11:
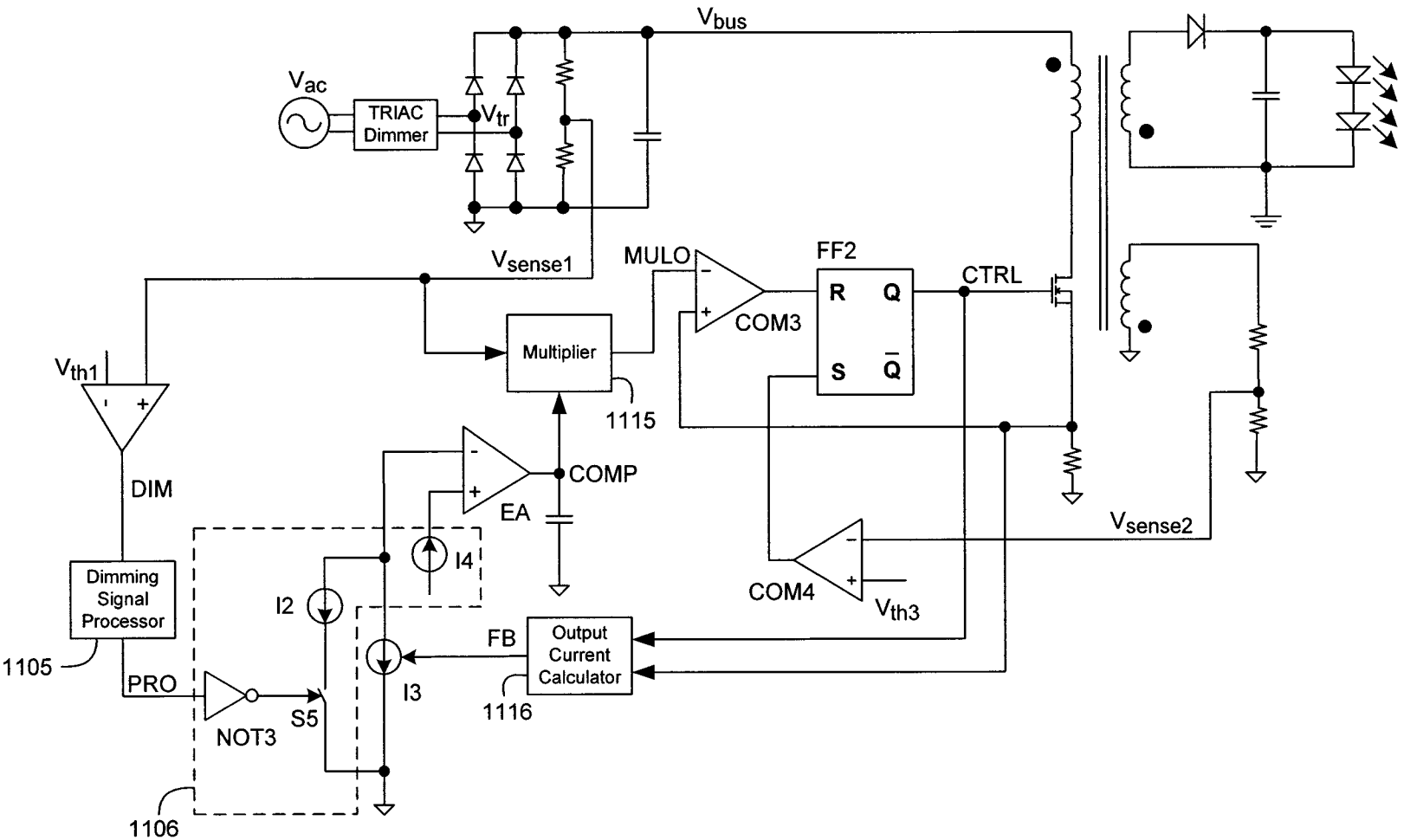
FIG. 11 illustrates a LED driver in accordance with another embodiment of the present disclosure.

FIG. 11 illustrates a LED driver in accordance with another embodiment of the present disclosure. Compared with the LED driver shown in FIG. 9, the switch control circuit 1107 further comprises a current source I3 coupled between the inverting input terminal of the error amplifier EA and the ground. The current value of the current source I3 is controlled by the feedback signal FB. The reference signal generator 1106 comprises a NOT gate NOT3, a switch S5 and current sources I2, I4. The current source I2 has a first terminal and a second terminal, wherein the first terminal is coupled to the inverting input terminal of the error amplifier EA. The switch S5 has a first terminal, a second terminal and a gate, wherein the first terminal is coupled to the second terminal of the current source I2 and the second terminal is grounded. The input terminal of the NOT gate NOT3 is coupled to the dimming signal processor 1105 to receive the processed dimming signal PRO. The output terminal of the NOT gate NOT3 is coupled to the gate of the switch S5. The current source I4 is coupled to the non-inverting input terminal of the error amplifier EA, wherein the current value of the current source I2 is larger than that of the current source I4.

The error amplifier EA is a transconductance amplifier. It regulates the average value I3+I2*(1−D−D1) of the current flowing from its inverting input terminal to be equal to the current I4 flowing into its non-inverting input terminal. That means the current value I3 corresponding to the feedback signal FB is regulated to I4−I2*(1−D−D1). Comparing with the formula K1*(D+D1)−K2, we can get K1=I2, K2=I2−I4. In one embodiment, I2 is 31 uA and I4 is 25 uA.

In the embodiments mentioned above, the dimming signal processor is not necessary. The reference signal generator may be directly coupled to the dimming signal generator to receive the dimming signal DIM, and generate the reference signal REF in accordance with the dimming signal DIM. The average value of the reference signal REF is K1*D−K2. The switch control circuit generates the control signal CTRL based on the reference signal REF and the feedback signal FB.

Figure 12:
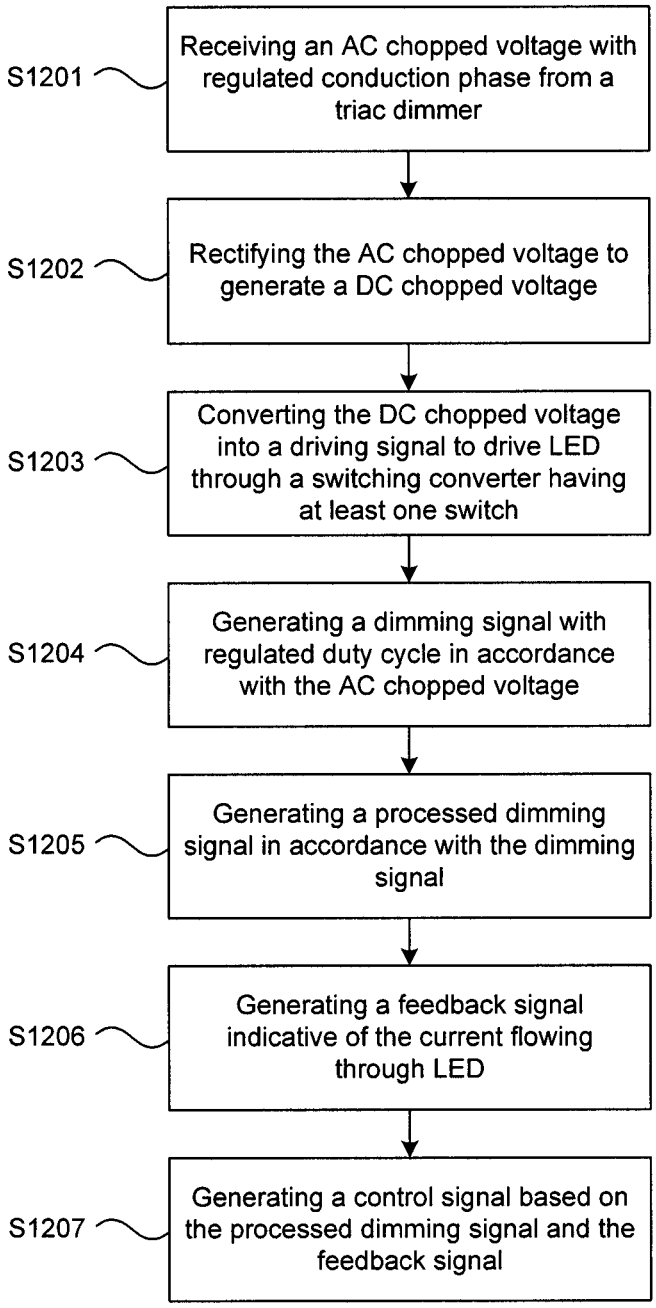
FIG. 12 is a flow chart of a method for driving LED, in accordance with an embodiment of the present disclosure.

FIG. 12 is a flow chart of a method for driving LED, in accordance with an embodiment of the present disclosure. The method comprises steps S1201~S1207.

At Step S1201, an AC chopped voltage with regulated conduction phase is received from a TRIAC dimmer.

At Step S1202, the AC chopped voltage is rectified to generate a DC chopped voltage.

At Step S1203, the DC chopped voltage is converted into a driving signal to drive LED through a switching converter having at least one switch.

At Step S1204, a dimming signal with regulated duty cycle is generated in accordance with the AC chopped voltage. In one embodiment, this step comprises: sensing the DC chopping voltage to generate a voltage sensing signal; and comparing the voltage sensing signal with a first threshold voltage to generate the dimming signal.

At Step S1205, a processed dimming signal is generated in accordance with the dimming signal, wherein the duty cycle of the processed dimming signal is a sum of a predetermined duty cycle and the duty cycle of the dimming signal.

At Step S1206, a feedback signal indicative of the current flowing through the LED is generated.

At Step S1207, a control signal is generated based on the processed dimming signal and the feedback signal to control the at least one switch in the switching converter.

In one embodiment, the step of generating the control signal comprises: generating a reference signal in accordance with the processed dimming signal, wherein the average value of the reference signal is the difference between the product of a first constant and the duty cycle of the processed dimming signal, and a second constant, and wherein the first constant is larger than the second constant; and generating the control signal based on the reference signal and the feedback signal. In one embodiment, the reference signal is an AC pulse signal, and the duty cycle of the reference signal is equal to that of the processed dimming signal.

In one embodiment, the generation of the processed dimming signal is not necessary. The reference signal may be generated directly in accordance with the dimming signal. The average value of the reference signal is the difference between the product of a first constant and the duty cycle of the dimming signal, and a second constant.

Obviously many modifications and variations of the present invention are possible in light of the above teachings. It is therefore to be understood that within the scope of the appended claims the invention may be practiced otherwise than as specifically described. It should be understood, of course, the foregoing disclosure relates only to a preferred embodiment (or embodiments) of the invention and that numerous modifications may be made therein without departing from the spirit and the scope of the invention as set forth in the appended claims. Various modifications are contemplated and they obviously will be resorted to by those skilled in the art without departing from the spirit and the scope of the invention as hereinafter defined by the appended claims as only a preferred embodiment(s) thereof has been disclosed.

We claim:

1. A controller used in a LED driver, wherein the LED driver comprises a TRIAC dimmer configured to receive an AC input voltage and to generate an AC chopped voltage having a regulated conduction phase based on the AC input voltage, a rectifier configured to generate a DC chopped voltage in accordance with the AC chopped voltage, and a switching converter having at least one switch, wherein the switching converter converts the DC chopped voltage into a driving signal to drive a LED, the controller comprises:

a dimming signal generator coupled to the TRIAC dimmer, wherein the dimming signal generator generates a dimming signal with regulated duty cycle in accordance with the AC chopped voltage;

a dimming signal processor coupled to the dimming signal generator, wherein the dimming signal processor generates a processed dimming signal in accordance with the dimming signal, and wherein the duty cycle of the processed dimming signal is a sum of a predetermined duty cycle and the duty cycle of the dimming signal; and a switch control circuit coupled to the dimming signal processor, wherein based on the processed dimming signal and a feedback signal indicative of the current flowing through the LED, the switch control circuit generates a control signal to control the at least one switch of the switching converter.

2. The controller of claim 1, wherein the dimming signal generator comprises:

a comparing circuit having a first input terminal, a second input terminal, and an output terminal, wherein the first terminal is configured to receive a voltage sensing signal indicative of the DC chopping voltage, the second terminal is configured to receive a first threshold voltage, and wherein based on the voltage sensing signal and the first threshold voltage, the comparing circuit provides the dimming signal to the dimming signal processor at the output terminal.

3. The controller of claim 1, wherein the dimming signal processor comprises:

a first NOT gate, wherein the input terminal of the first NOT gate is coupled to the dimming signal generator to receive the dimming signal;

a one shot circuit having an input terminal and an output terminal, wherein the input terminal of the one shot circuit is coupled to the output terminal of the first NOT gate;

a first current source;

a capacitor having a first terminal and a second terminal, wherein the first terminal is coupled to the first current source, the second terminal is grounded;

a second switch having a first terminal, a second terminal, and a gate, wherein the second switch is coupled to the capacitor in parallel via the first and second terminals, wherein the gate of the second switch is coupled to the output terminal of the one shot circuit;

a comparator having a non-inverting input terminal, an inverting input terminal and an output terminal, wherein the non-inverting input terminal of the comparator is coupled to the first terminal of the capacitor, the inverting input terminal of the comparator is configured to receive a second threshold voltage; and a flip flop having a set terminal, a reset terminal and an output terminal, wherein the set terminal is coupled to the dimming signal generator to receive the dimming signal, the reset terminal is coupled to the output terminal of the comparator, and the output terminal is coupled to the switch control circuit to provide the processed dimming signal.

4. The controller of claim 3, wherein the dimming signal processor further comprises:

a delay circuit coupled between the output terminal of the one shot circuit and the gate of the second switch;

a sample and hold circuit having a first input terminal, a second input terminal and an output terminal, wherein the first input terminal is coupled to the output terminal of the one shot circuit, the second input terminal is coupled to the first terminal of the capacitor, and wherein based on the output signal of the one shot circuit and the voltage across the capacitor, the sample and hold circuit provides a sample and hold signal indicative of the peak voltage across the capacitor at the output terminal; and a voltage divider having an input terminal and an output terminal, wherein the input terminal of the voltage divider is coupled to the sample and hold circuit to receive the sample and hold signal, the output terminal of the voltage divider is coupled to the inverting input terminal of the comparator to provide the second threshold voltage.

5. The controller of claim 1, further comprising:

a reference signal generator coupled between the dimming signal processor and the switch control circuit, wherein the reference signal generator is configured to generate a reference signal in accordance with the processed dimming signal, the average value of the reference signal is the difference between the product of a first constant and the duty cycle of the processed dimming signal, and a second constant, wherein the first constant is larger than the second constant;

wherein the switch control circuit generates the control signal based on the reference signal and the feedback signal.

6. The controller of claim 5, wherein the reference signal generator comprises:

a third switch having a first terminal, a second terminal, and a gate, wherein the first terminal is configured to receive a first voltage, the gate is coupled to the dimming signal processor to receive the processed dimming signal;

a second NOT gate having an input terminal and an output terminal, wherein the input terminal of the second NOT gate is coupled to the dimming signal processor to receive the processed dimming signal; and a fourth switch having a first terminal, a second terminal, and a gate, wherein the first terminal is coupled to the second terminal of the third switch to provide the reference signal, the second terminal is configured to receive a second voltage, the gate is coupled to the output terminal of the second NOT gate;

wherein the first voltage is positive and the second voltage is negative.

7. The controller of claim 5, wherein the switch control circuit comprises:

an error amplifier coupled to the reference signal generator, wherein the error amplifier is configured to generate a compensation signal based on the reference signal and the feedback signal; and a logic circuit coupled to the error amplifier, wherein the logic circuit is configured to generate the control signal based on the compensation signal.

8. The controller of claim 7, wherein the switch control circuit further comprises a third current source coupled between the inverting input terminal of the error amplifier and the ground, the current value of the third current source is controlled by the feedback signal, and wherein the reference signal generator comprises:

a second current source having a first terminal and a second terminal, wherein the first terminal is coupled to the inverting input terminal of the error amplifier;

a fifth switch having a first terminal, a second terminal, and a gate, wherein the first terminal is coupled to the second terminal of the second current source, the second terminal is grounded;

a third NOT gate having an input terminal and an output terminal, wherein the input terminal of the third NOT gate is coupled to the dimming signal processor to receive the processed dimming signal, the output terminal of the third NOT gate is coupled to the gate of the fifth switch; and a fourth current source coupled to the non-inverting input terminal of the error amplifier;

wherein the current value of the second current source is larger than that of the fourth current source.

9. A controller used in a LED driver, wherein the LED driver comprises a TRIAC dimmer configured to receive an AC input voltage and generate an AC chopped voltage having regulated conduction phase based on the AC input voltage, a rectifier configured to generate a DC chopped voltage in accordance with the AC chopped voltage, and a switching converter having at least one switch, wherein the switching converter converts the DC chopped voltage into a driving signal to drive LED, the controller comprises:

a dimming signal generator coupled to the TRIAC dimmer, wherein the dimming signal generator generates a dimming signal with regulated duty cycle in accordance with the AC chopped voltage;

a reference signal generator coupled to the dimming signal generator, wherein the reference signal generator generates a reference signal in accordance with the dimming signal, the average value of the reference signal is the difference between the product of a first constant and the duty cycle of the dimming signal, and a second constant, wherein the first constant is larger than the second constant; and a switch control circuit coupled to the reference signal generator, wherein based on the reference signal and a feedback signal indicative of the current flowing through LED, the switch control circuit generates a control signal to control the at least one switch.

10. The controller of claim 9, wherein the dimming signal generator comprises:

a comparing circuit having a first input terminal, a second input terminal, and an output terminal, wherein the first terminal is configured to receive a voltage sensing signal indicative of the DC chopping voltage, the second terminal is configured to receive a first threshold voltage, and wherein based on the voltage sensing signal and the first threshold voltage, the comparing circuit provides the dimming signal to the reference signal generator at the output terminal.

11. The controller of claim 9, wherein the reference signal generator comprises:

a third switch having a first terminal, a second terminal, and a gate, wherein the first terminal is configured to receive a first voltage, the gate is coupled to the dimming signal generator to receive the dimming signal;

a second NOT gate having an input terminal and an output terminal, wherein the input terminal of the second NOT gate is coupled to the dimming signal generator to receive the dimming signal; and a fourth switch having a first terminal, a second terminal, and a gate, wherein the first terminal is coupled to the second terminal of the third switch to provide the reference signal, the second terminal is configured to receive a second voltage, the gate is coupled to the output terminal of the second NOT gate;

wherein the first voltage is positive and the second voltage is negative.

12. The controller of claim 9, wherein the switch control circuit comprises:

an error amplifier coupled to the reference signal generator, wherein the error amplifier is configured to generate a compensation signal based on the reference signal and the feedback signal; and a logic circuit coupled to the error amplifier, wherein the logic circuit is configured to generate the control signal based on the compensation signal.

13. The controller of claim 12, wherein the switch control circuit further comprises a third current source coupled between the inverting input terminal of the error amplifier and the ground, the current value of the third current source is controlled by the feedback signal, and wherein the reference signal generator comprises:

a second current source having a first terminal and a second terminal, wherein the first terminal is coupled to the inverting input terminal of the error amplifier;

a fifth switch having a first terminal, a second terminal, and a gate, wherein the first terminal is coupled to the second terminal of the second current source, the second terminal is grounded;

a third NOT gate having an input terminal and an output terminal, wherein the input terminal of the third NOT gate is coupled to the dimming signal generator to receive the dimming signal, the output terminal of the third NOT gate is coupled to the gate of the fifth switch; and a fourth current source coupled to the non-inverting input terminal of the error amplifier;

wherein the current value of the second current source is larger than that of the fourth current source.

14. A method for driving a LED, comprising:

receiving an AC chopped voltage with regulated conduction phase from a TRIAC dimmer;

rectifying the AC chopped voltage to generate a DC chopped voltage;

converting the DC chopped voltage into a driving signal to drive the LED through a switching converter having at least one switch;

generating a dimming signal with regulated duty cycle in accordance with the AC chopped voltage;

generating a processed dimming signal in accordance with the dimming signal, wherein the duty cycle of the processed dimming signal is a sum of a predetermined duty cycle and the duty cycle of the dimming signal;

generating a feedback signal indicative of the current flowing through LED; and generating a control signal based on the processed dimming signal and the feedback signal to control the at least one switch.

15. The method of claim 14, wherein the step of generating the dimming signal comprises:

sensing the DC chopping voltage to generate a voltage sensing signal; and comparing the voltage sensing signal with a first threshold voltage to generate the dimming signal.

16. The method of claim 14, wherein the step of generating the control signal comprises:

generating a reference signal in accordance with the processed dimming signal, wherein the average value of the reference signal is the difference between the product of a first constant and the duty cycle of the processed dimming signal, and a second constant, and wherein the first constant is larger than the second constant; and generating the control signal based on the reference signal and the feedback signal.

17. The method of claim 16, wherein the reference signal is an AC pulse signal, and the duty cycle of the reference signal is equal to that of the processed dimming signal.

18. The method of claim 16, wherein the step of generating the processed dimming signal is eliminated, and the reference signal is generated in accordance with the dimming signal instead, wherein the average value of the reference signal is the difference between the product of the first constant and the duty cycle of the dimming signal, and the second constant.

19. The method of claim 18, wherein the reference signal is an AC pulse signal, and the duty cycle of the reference signal is equal to that of the dimming signal.

* * * * *